United States Patent [19]

Suggs

[11] Patent Number: 4,964,213

[45] Date of Patent: Oct. 23, 1990

[54] NAIL CUTTING DEVICE AND ASSOCIATED METHOD FOR TREATING AND/OR PREVENTING INGROWN NAILS

[76] Inventor: Patricia A. Suggs, Route 14, Box 831A, Sevierville, Tenn. 37862

[21] Appl. No.: 241,412

[22] Filed: Sep. 7, 1988

Related U.S. Application Data

[63] Continuation-in-part of Ser. No. 106,167, Oct. 8, 1987.

[51] Int. Cl.[5] ..... A45D 29/18

[52] U.S. Cl. ..... 30/28; 132/75.5; 132/200

[58] Field of Search ..... 30/28, 26; 132/75.3, 132/200

[56] References Cited

U.S. PATENT DOCUMENTS

| | | | |
|---|---|---|---|
| 702,516 | 6/1902 | Wilcox | 132/75.5 |
| 1,433,936 | 10/1922 | Campbell | 30/28 X |
| 2,774,138 | 12/1956 | Gowdey | 30/28 |
| 3,315,354 | 4/1967 | Oates | 30/28 |

*Primary Examiner*—Douglas D. Watts
*Attorney, Agent, or Firm*—Pitts and Brittian

[57] ABSTRACT

A nail cutting device and associated method for treating and/or preventing ingrown nails. The nail cutting device (10) comprises a first member (14) having a forward end portion (20) defining an upper jaw (24) provided with a protruding blade portion (26) and a second member (16) having a forward end portion (22) defining a lower jaw (25) which, in the preferred embodiment defines an anvil (28), operatively associated with the blade portion (26). The device (10) also includes actuator means for moving the blade portion (26) toward and into contact with the anvil (28). The method of the present invention includes the steps of inserting the anterior extremity (48) of the nail (50) between the blade portion (26) and the anvil (28), and actuating the actuating means to move the blade portion (26) through the nail (50) to produce a notch (54) in the anterior extremity (48) of the nail (50).

6 Claims, 2 Drawing Sheets

NAIL CUTTING DEVICE AND ASSOCIATED METHOD FOR TREATING AND/OR PREVENTING INGROWN NAILS

This invention is a Continuation-In-Part of U.S. patent application Ser. No. 106,167, filed Oct. 8, 1987.

TECHNICAL FIELD

This invention relates to a nail cutting device and an associated method for treating and/or preventing ingrown nails. More specifically, the device includes a protruding blade portion for cutting a notch in the anterior extremity of a nail in order to redirect growth of the nail.

BACKGROUND ART

The condition wherein the edge of a toe or finger nail grows into the soft tissue of the digit, causing inflammation and on occasions an abscess, is generally called an ingrown nail. Ingrown nails are often caused by improper clipping of the nail. In this regard, conventional nail clippers cut the nail with a slight curvature across the anterior extremity, leaving the outer edges of the nail to grow outward, and downward, into the adjacent soft tissue. Certain conventional nail clipping devices are disclosed in U.S. Pat. Nos. 702,516; 2,774,138; 3,430,340; and 4,637,137. However, none of these devices has provided a clipping means which influences future growth of the nail so as to relieve pressure on the soft tissue and prevent future ingrowth.

Therefore, it is an object of the present invention to provide a nail cutting device and associated method for treating and/or preventing ingrown nails.

It is another object of the present invention to provide a nail cutting device for producing a notch in the anterior extremity of a nail to facilitate redirection of nail growth toward the center of the nail to prevent ingrowth of the nail into the soft tissue adjacent the nail.

Yet another object of the present invention is to provide a nail cutting device which is inexpensive to manufacture and easy to use.

DISCLOSURE OF THE INVENTION

Other objects and advantages will be accomplished by the present invention which provides a nail cutting device and an associated method for treating and/or preventing ingrown nails. The nail cutting device comprises a first or upper member having a forward end portion defining an upper jaw provided with a protruding blade end portion, and a second or lower member having a forward end portion defining a lower jaw provided with a protruding member operatively associated with the protruding blade of the upper member. In the preferred embodiment, the protruding member defines an anvil to provide a cutting surface for the protruding blade. Actuator means are also provided for bringing the blade portion and the anvil together to effect the cutting of the nail. The method of treating and preventing ingrown nails of the present invention comprises the steps of inserting the anterior extremity of the nail between the blade portion and anvil of the cutting device and actuating the actuating means to force the blade portion through the nail so as to produce a notch in the anterior extremity of the nail. This notch serves to relieve pressure on the soft tissue adjacent the nail where ingrowth has occurred, or will likely occur, and facilitate nail growth directed toward the center of the nail.

BRIEF DESCRIPTION OF THE DRAWINGS

The above-mentioned features of the present invention will become more clearly understood from the following detailed description of the invention read together with the drawings in which.

BEST MODE FOR CARRYING OUT THE INVENTION

Figure 2:
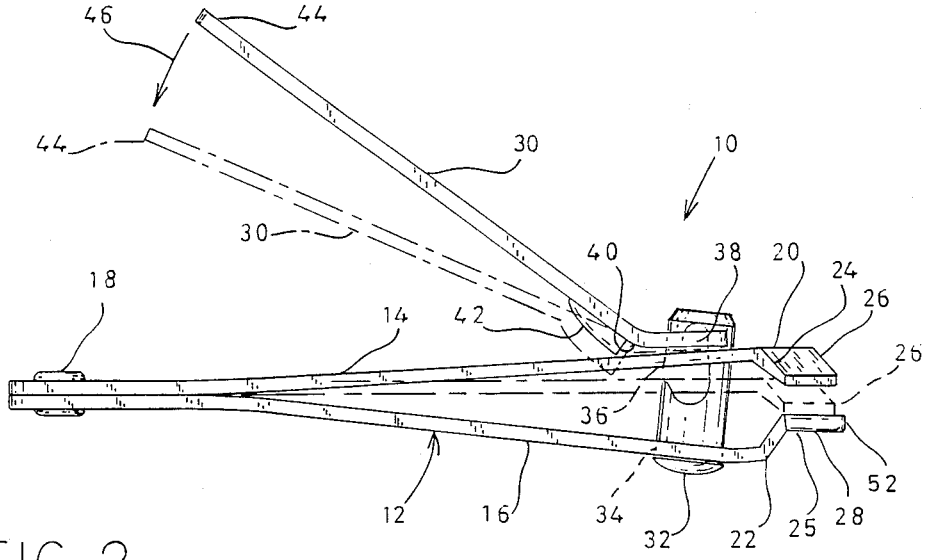
FIG. 2 illustrates a side elevation view of a nail cutting device of the present invention.

A nail cutting device incorporating various features of the present invention is illustrated generally at 10 in the figures. The cutting device 10 is utilized to cut a notch in the anterior extremity of a toe or finger nail as a method of treating and preventing ingrown nails, as will be discussed in detail below. The cutting device 10 comprises a body 12, including an upper member 14 and a lower member 16. The upper and lower members 14 and 16 are joined at, or proximate, their rearward end portions, with a fastener such as the illustrated rivet 18. As is best illustrated in FIG. 2, the members 14 and 16 are configured such that their forward end portions 20 and 22, respectively, are spaced apart a selected distance, and are preferably fabricated of resilient metal such that whereas the forward end portions 20 and 22 bias toward the spaced apart position, sufficient pressure exerted on the members 14 and 16 will bring the forward end portions 20 and 22 together.

Figure 1:
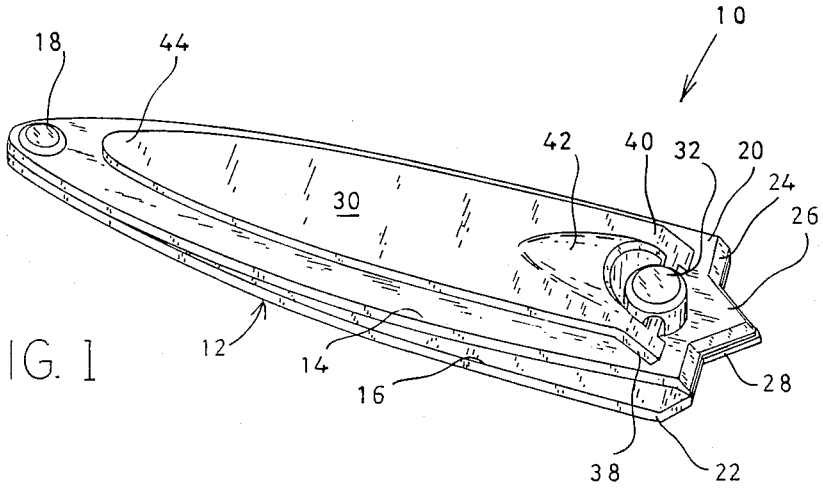
FIG. 1 illustrates a perspective view of a nail cutting device of the present invention.

As is best illustrated in FIG. 1, the forward end portion 20 of the upper member 14 defines an upper jaw 24 provided with a protruding blade portion 26 having a downwardly disposed cutting edge. In the preferred embodiment, the blade portion 26 is substantially V-shaped so as to produce a V-shaped notch in the nail being cut. Further, the forward end portion 22 of the lower member 16 defines a lower jaw 25 provided with a protruding member which, in the preferred embodiment, defines a protruding anvil 28 which registers with, and selectively engages, the protruding blade portion 26 as the forward end portions 20 and 22 are brought together.

In order to selectively bring the forward end portion 20 and 22 of the members 14 and 16 together to perform the cutting operation, the device 10 is provided with actuator means for overcoming the outward bias of the members 14 and 16 and forcing the blade portion 26 in the direction of the anvil 28. In the preferred embodiment, such actuator means comprises a lever arm 30 secured to the upper and lower members 14 and 16 with a pivot bolt 32. More specifically, the bolt 32 is rotatably and slidably received through a hole 34 provide in the member 16 proximate the forward end portion 22, and through a further hole 36 provided in the member 14 proximate the forward end portion 20. The lever arm 30 is pivotally secured proximate its first end portion 38 to the bolt 32 above the upper member 14. Further, the lever arm is provided with a bend 40 proximate the first end portion, such that lever arm 30 diverges from upper member 14, and is also provided, in the preferred embodiment with a protruding member 42 which selectively engages the upper member 14 and serves as a fulcrum for the lever arm 30. Accordingly, it will be understood by those skilled in the art that when the free end portion 44 of the lever arm 30 is pivoted in the direction of the arrow 46 (See FIG. 2), the protruding member 42 forces the upper member 14 downwardly and forces the protruding blade portion 26 against the anvil 28 of the lower member 16. Thus, the cutting of the nail is accomplished by placing the nail between the blade portion 26 and the anvil 28 and pivoting the lever arm to bring the blade portion and the anvil 28 together.

As discussed above, the pivot bolt 32 is rotatably received in the holes 34 and 36. This allows the lever arm 30 to be placed in the storage position illustrated in FIG. 1. This is accomplished by rotating the bolt 32 one hundred and eighty (180) degrees from the position illustrated in FIG. 2 and pivoting the lever arm 30 back against the upper member 14.

Figure 3:
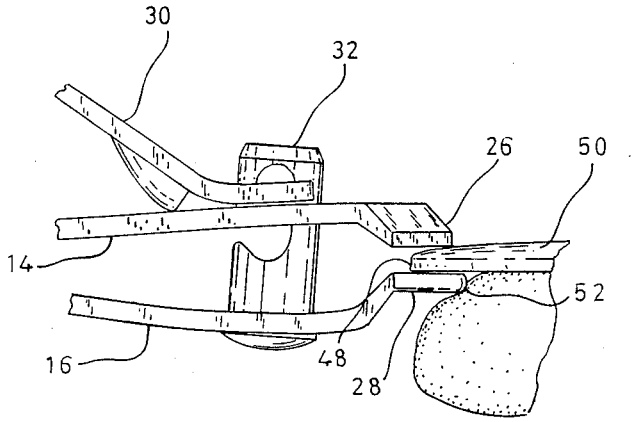
FIG. 3 illustrates a partial side elevation view of a nail cutting device of the present invention.
Figure 4:
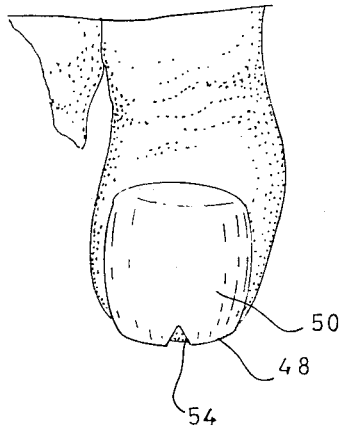
FIG. 4 is a top view of a human digit illustrating a nail provided with a notch in the anterior extremity in accordance with the method of the present invention.

The nail cutting device 10 is designed for use in the treatment and prevention of ingrown nails. In the treatment and prevention method of the present invention, the anvil 28 is inserted beneath the anterior extremity 48 of the nail 50 (See FIG. 3). It will be recognized that, unlike conventional nail clippers, in the preferred embodiment, the device 10 has no lower blade, and, thus, the danger of injury to the soft tissue below the nail is avoided. Moreover, in the preferred embodiment, the anvil 28 defines a blunted end portion 52 to further insure that soft tissue beneath the nail is not damaged when the anvil 28 is placed in position. However, it will be understood that the protruding member of the lower member 16 can define a blade portion registering with the blade portion 26 if desired. With the anvil 28 in place, the lever arm 30 is then actuated to bring the blade portion 26 and the anvil 28 together, cutting the nail tissue therebetween. Resultantly, a notch 54 is produced in the anterior extremity 48 of the nail 50 (See FIG. 4). In this regard, it has been discovered that where such a notch 54 is made in the nail, future nail growth is directed inward, toward the center of the nail, and in the direction of the notch rather than outwardly, into the soft tissue which borders the sides of the nail. Thus, where there is a pre-existing ingrown nail, the redirection of growth precipitated by the notch relieves the pressure of the nail on the damaged soft tissue, thereby relieving pain and accelerating the healing process. Further, even where there is no pre-existing ingrowth of the nail, the redirecting of future growth toward the center of the nail can prevent future ingrowth of the nail into the bordering soft tissues.

It will be noted that in the preferred embodiment, the blade portion 26 defines a V-shaped blade member so as to produce a V-shaped notch in the nail. However, it will be understood that the configuration of the protruding blade portion 26 can vary, with the intent being to provide a blade portion which produces a notch or gap in the nail to allow growth to be redirected from the area of the nail ingrowth.

While a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. A nail cutting device for cutting a symmetrical V-shaped notch in the approximate center of the anterior extremity of a nail for treating and/or preventing ingrown nails, said device comprising:

a first member having a forward end portion defining a first jaw provided with a protruding cutting blade portion, said protruding cutting blade portion being disposed in the center of said forward end portion and V-shaped so as to cut said V-shaped notch in said nail;

a second member having a forward end portion defining a second jaw provided with an anvil operatively associated with said protruding V-shaped cutting blade portion; and actuator means for moving said protruding V-shaped cutting blade portion toward and into contact with said second jaw whereby said V-shaped notch is cut into the approximate center of said nail by inserting said anterior extremity of said nail between said protruding cutting blade portion and said anvil of said second jaw and actuating said actuator means to force said cutting blade portion through said nail and against said anvil of said second jaw.

2. The nail cutting device of claim 1 wherein said anvil of said second jaw has a smooth rounded edge to prevent injury to the flesh underneath said nail.

3. The nail cutting device of claim 2 wherein said first and second members each define a rearward end portion, said rearward end portion of said first member being secured to said rearward end portion of said second member, said forward end portions of said first and second members being outwardly biased to selectively spaced positions.

4. The nail cutting device of claim 3 wherein said first member defines a hole proximate said forward end portion of said first member, and said second member defines a further hole proximate said forward end portion of said second member and wherein said actuator means includes a lever arm having a first end portion, and a bolt slidably received through said further hole of said second member and through said hole of said first member to pivotally engage said first end portion of said lever arm, whereby selected manipulation of said lever arm moves said protruding V-shaped cutting blade portion toward said protruding anvil.

5. A method for treating and/or preventing ingrown nails, said method utilizing a nail cutting device having a first member defining a first jaw provided with a protruding V-shaped cutting blade portion and a second member defining a second jaw with a protruding anvil for mating with said V-shaped cutting blade portion, and including actuator means for moving said V-shaped cutting blade portion toward said second jaw for accomplishing the cutting of a V-shaped notch into the approximate center of said nail, said method comprising the steps of inserting the approximate center of the anterior extremity of said nail between said protruding V-shaped cutting blade member and said anvil of said second jaw of said second member, and actuating said actuating means to move said V-shaped cutting blade portion through said nail, thereby producing said V-shaped notch in said approximate center of said anterior extremity of said nail.

6. A nail cutting device for cutting a symmetrical V-shaped notch in the approximate center of the anterior extremity of a nail for treating and/or preventing ingrown nails, said device comprising:

a first member having forward and rearward end portions, said forward end portion having side portions, said forward end portion carrying a protruding cutting blade portion defining a V-shaped configuration, said V-shaped configuration being located proximate a center point between said side portions of said forward end portion, said first member being provided with a hole proximate said forward end portion;

a second member having forward and rearward end portions, said forward end portion of said second member defining an anvil configured for selectively engaging said protruding V-shaped cutting blade portion said anvil provided with a rounded forward edge to prevent injury to tissue beneath said nail, said rearward end portion of said second member being secured to said rearward end portion of said first member, said forward end portions of said first and second members being outwardly biased to selectively spaced apart positions, said second member being provided with a further hole proximate said forward end portion; and actuator means for moving said protruding V-shaped cutting blade portion toward and into contact with said anvil, said actuator means including a lever arm having a first end portion, and a bolt slidably received through said further hole of said second member and through said hole of said first member to pivotally engage said first end portion of said lever arm, whereby selected manipulation of said lever arm moves said protruding V-shaped cutting blade portion toward and into contact with said anvil.

* * * * *